United States Patent [19]

Yokota et al.

[11] Patent Number: 4,636,684

[45] Date of Patent: Jan. 13, 1987

[54] COLOR TELEVISION DISPLAY APPARATUS HAVING IMPROVED CONVERGENCE OF ELECTRON BEAMS

[75] Inventors: Yutaka Yokota, Amagasaki; Hiroshi Shimasaki, Osaka, both of Japan

[73] Assignee: Sanyo Electric Co., Ltd., Osaka, Japan

[21] Appl. No.: 658,257

[22] Filed: Oct. 5, 1984

[30] Foreign Application Priority Data

Oct. 7, 1983 [JP] Japan ..... 58-156213[U]

[51] Int. Cl.[4] ..... H01J 29/46; H01F 3/12

[52] U.S. Cl. ..... 313/412; 313/440; 335/211; 335/214

[58] Field of Search ..... 313/412, 428, 431, 433, 313/437, 440; 335/211, 212, 214

[56] References Cited

U.S. PATENT DOCUMENTS 4,257,023 3/1981 Kamijo ..... 335/211

4,335,366 6/1982 Alig et al. ..... 335/211

FOREIGN PATENT DOCUMENTS 58-18210 4/1983 Japan .

*Primary Examiner*—David K. Moore

*Assistant Examiner*—K. Wilder

*Attorney, Agent, or Firm*—Armstrong, Nikaido, Marmelstein & Kubovcik

[57] ABSTRACT

A color television display apparatus comprises a color cathode ray tube (1), an electron gun apparatus (4) disposed in a neck region (2) of the color cathode ray tube (1), a deflection yoke (12) having vertical deflection coils (14) wound about a toroidal-type core (13) and magnetic members (18). Each magnetic member (18) is shaped nearly like a letter U, comprising: a first portion (19) adjacent to the rear end surface of the core (13), extending in a direction perpendicular to the center axis of the neck region (2); a second portion (20) extending backward from the outer end of the first portion (19); and a third portion (21) positioned opposed to the beam exit end of the electron gun apparatus (4) outside the neck region (2), extending in a direction perpendicular to the center axis of the neck region (2). The first portion (19) receives mainly leakage flux existing in the rear end surface of the core (13) and the received flux is transmitted to the third portion (21) through the second portion (20) so as to be emitted to the beam exit end of the electron gun apparatus (4) as an effective magnetic flux.

8 Claims, 16 Drawing Figures

COLOR TELEVISION DISPLAY APPARATUS HAVING IMPROVED CONVERGENCE OF ELECTRON BEAMS

BACKGROUND OF THE INVENTION

1. Field of the Invention

The present invention relates to a color television display apparatus having improved convergence of electron beams, by which leakage flux caused by vertical deflection coils unfavorably affecting the convergence of electron beams can be removed.

2. Description of the Prior Art

In a color television display apparatus, it is generally recognized that a trailing phenomenon in movement of a picture near the end portions of a screen, namely, so-called flare occurs. Such flare can be avoided by using a magnetically-permeable material for a focusing electrode of an electron gun instead of a non-magnetic material as conventionally utilized. However, such use of a magnetically-permeable material causes another problem that convergence of a display apparatus deteriorates. This is because the leakage flux caused by the vertical deflection coils provided for effecting vertical deflection of the electron beams is formed in a pincushion shape in the focusing electrode of the electron gun, exerting unfavorable influence on the focusing of the electron beams.

Accordingly, means for compensating for the deterioration of convergence namely, misconvergence, in case of using such a magnetically-permeable focusing electrode was proposed in the specification of U.S. Pat. No. 4,335,366 issued June 15, 1982 to Roger C. Alig et al and assigned to RCA Corporation, New York, N.Y., U.S.A. A magnetic member for compensation for misconvergence as proposed in the above stated patent comprises a first portion for collecting leakage flux of the vertical deflection coils and a second portion disposed approximately perpendicular to a neck region of a cathode ray tube, for supplying the collected vertical leakage flux to the vicinity of the exit end of the electron beams.

However, the above stated first portion covers approximately half of the exterior of the vertical deflection coils, which involves a disadvantage that such a magnetic member as described above needs be of a large size. In addition, in such a magnetic member located externally to the vertical deflection coils, there is another disadvantage that a satisfactory effect of compensation for misconvergence cannot be obtained.

Furthermore, in case of a display apparatus being of a type in which a magnetic piece for channelling a vertical leakage field to the front end of a deflection yoke, namely a so-called cross arm, as proposed for example in U.S. Pat. No. 4,257,023 issued Mar. 17, 1981 to Naoyoshi Kamijo et al and assigned to Tokyo Shibaura Denki Kabushiki Kaisha, Kawasaki, Japan is provided for the purpose of correcting the pincushion distortion of a raster, if a large-sized magnetic member as already proposed above is attached, the above stated cross arm and the attached magnetic member would magnetically interact with each other, resulting in hindrance to the achievement of the desired effects.

As another proposal for compensation of misconvergence, an invention described in Japanese Utility Model Publication No. 18210/1983 may be preferred. This invention comprises a core about which vertical deflection coils are wound and a pair of magnetic pieces coupled to the core and protruding backward from the core. With such pair of magnetic pieces protruding backward, the center of the magnetic field of the vertical deflection coils can in appearance deviate backward in the cathode ray tube, whereby the deflection sensitivity can be improved. In other words, the above mentioned invention intends to exclude the unfavorable influences due to the leakage field by deviation from the center of the magnetic field without changing the absolute quantity of effective magnetic flux produced by the vertical deflection coils.

On the other hand, in the invention of the present application or the above stated U.S. Pat. No. 4,335,366, leakage flux is received by a magnetic member or the like and the received flux is transmitted to a predetermined place as an effective magnetic flux and, therefore, the objects and the structure of the present invention or the above stated U.S. patent are different from those of the above stated Japanese Utility Model Publication No. 18210/1983.

SUMMARY OF THE INVENTION

A primary object of the present invention is to provide a color television display apparatus comprising an electron gun having a focusing electrode made of a magnetically-permeable material, said apparatus being provided with small-sized magnetically-permeable means for excluding unfavorable influences exerted on the focusing electrode by the leakage field produced by the vertical deflection coils so as to compensate for misconvergence.

Another object of the present invention is to provide a color television display apparatus by which pincushion distortion can be corrected.

A further object of the present invention is to improve the vertical deflection efficiency in a color television display apparatus.

Briefly stated, the present invention is structured by a magnetically-permeable member shaped nearly like a letter U in which magnetically-permeable means for bringing a leakage field of the vertical deflection coils to the beam exit end of an electron gun comprises a first portion, a second portion and a third portion. The first portion is positioned adjacent to the rear end surface of a core about which vertical deflection coils are wound, extending toward the center axis of a neck region, in a direction perpendicular to the center axis. This first portion functions to receive the leakage flux produced mainly in the rear end portion of the core. The second portion extends backward from the outer end of the first portion and functions to transmit the magnetic flux received by the first portion in the backward direction. The third portion is coupled to the rear end of the second portion, extending toward the center axis of the neck region, in a direction perpendicular thereto. This third portion is positioned corresponding to the beam exit end of the electron gun. The third portion functions to emit the magnetic flux transmitted through the first portion and the second portion to the beam exit end.

Thus, the magnetically-permeable means comprises the first portion, the second portion and the third portion, the respective portions being disposed in the positions where the desired functions can be performed most effectively. Accordingly, the unfavorable influences caused by the leakage field of the vertical deflection coils can be excluded effectively and compensation for misconvergence can be made efficiently. At the same time, pincushion distortion can be mitigated and vertical deflection efficiency can be improved. In addition, since the present invention has a structure comprising three portions as described above, the shape and the size can be made as simple and as small as possible and by using a small-sized magnetically-permeable means, it becomes possible to exclude efficiently the unfavorable influences caused by a leakage field.

In a preferred embodiment of the present invention, the top end of the first portion is bent at an angle of approximately 90° in the direction of the core and a fourth portion is formed to protrude in a manner penetrating inside the rear end surface of the core.

Accordingly, in this preferred embodiment, leakage flux is also received by this fourth portion and consequently the magnetically-permeable means can functions more efficiently.

The present invention is suitable particularly for a display apparatus of a type in which a so-called cross arm for transmitting the vertical leakage field toward the front end of a deflection yoke is provided for correcting the pincushion distortion of a raster. This is because the cross arm and the magnetically-permeable means can achieve the desired effects efficiently without causing magnetic interference therebetween since the magnetically-permeable means attached at the rear end of the deflection yoke is of a small size.

These objects and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
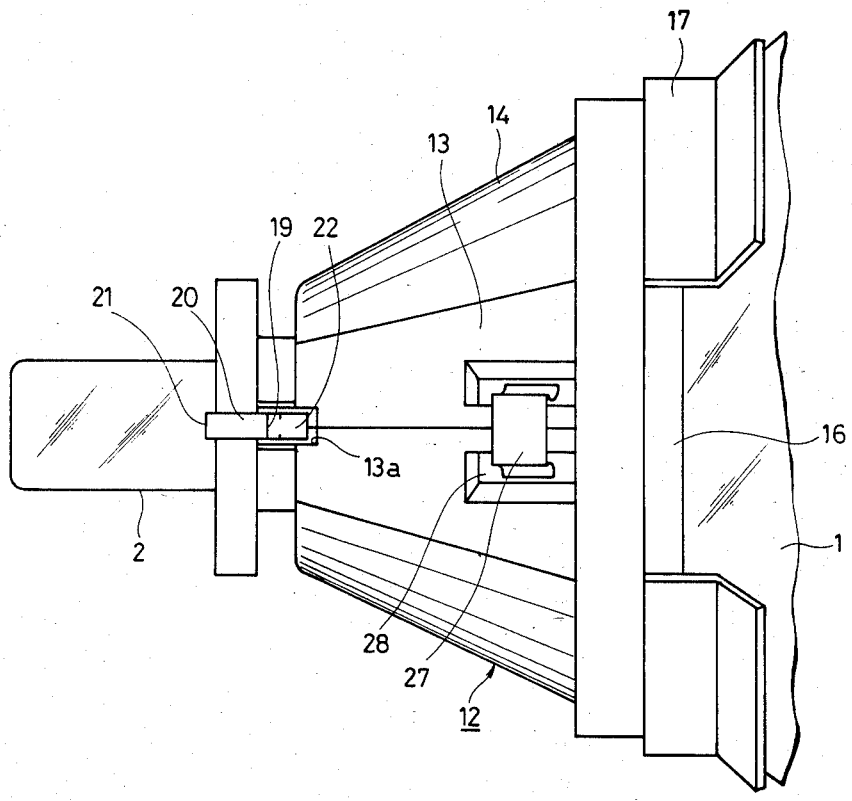
FIG. 1 is a partial left side view of a color television display apparatus in accordance with the present invention.
Figure 2:
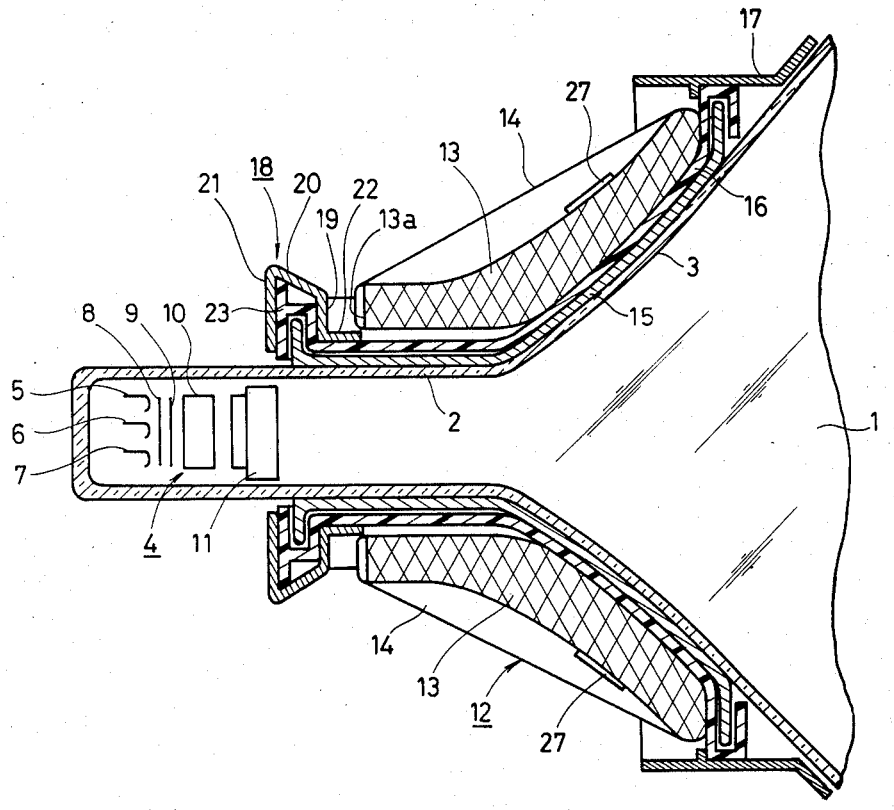
FIG. 2 is a partial plane sectional view of a color television display apparatus in accordance with the present invention.

FIG. 1 is a partial left side view of a color television display system of a preferred embodiment of the present invention and FIG. 2 is a plane sectional view thereof. Referring to FIGS. 1 and 2, a color cathode ray tube 1 comprises a cylindrical neck region 2 formed at the rear thereof to extend horizontally and a display screen, not shown, formed at the top end thereof, the neck region 2 and the display screen being connected by a funnel region 3 enlarged toward the direction of the top end. Within the interior of the neck region 2, an electron gun apparatus 4 is disposed. The electron gun apparatus 4 has a structure in which three in-line cathode assemblies 5, 6 and 7, a control grid electrode 8, a screen grid electrode 19, a magnetically-permeable focusing electrode 10 and a second focusing and accelerating electrode 11 are disposed in order from the left to the right in the drawing. Around the outer circumference from the top end portion of the neck region 2 of the cathode ray tube to the rear portion of the funnel region 3, a deflection yoke 12 is attached. The deflection yoke 12 comprises a magnetically-permeable core 13 of a toroidal type, a pair of vertical deflection coils 14 wound about the core 13, a pair of saddle-wound horizontal deflection coils 15 positioned inside the core 13 and plastic liners insulator 16 for insulation between the vertical deflection coils 14 and the horizontal deflection coils 15. The vertical deflection coils 14 are disposed outside the plastic liners 16, while the horizontal deflection coils 15 are disposed inside the plastic liners 16. At the top end of these deflection coils, a pair of so-called cross arms 17 is provided. The cross arms 17 collect the vertical leakage field produced at the top end of the deflection yoke 12 by means of the vertical deflection coils 14 and emit the collected magnetic field to the front side of the deflection yoke 12 to apply good effects to the electron beams so that raster distortion at the four corners of the display screen not shown can be suppressed. The cross arms 17 in this embodiment have rear ends fixed to the plastic liners 16 of the deflection yoke 12 and top ends in contact with the funnel region 3 of the color cathode ray tube 1. At the rear of the deflection yoke 12, a magnetic member 18 in accordance with the present invention is provided. This magnetic member 18 comprises a first portion 19, a second portion 20, a third portion 21 and a fourth portion 22, arranged in a letter U with a shelf at one end. The first portion 19 is opposed adjacent to the rear end surface 13*a* of the toroidal-type core 13 and extends in a direction perpendicular to the center axis of the neck region 2. This first portion 19 functions to receive leakage flux existing in the vicinity of the rear end surface 13*a* of the core 13. The second portion 20 extends backward from the outer end of the first portion 19, so that the magnetic flux received by the first portion 19 may be transmitted to the backward third portion 21 through the second portion 20. The third portion 21 is joined continuously to the rear end of the second portion 20, extending in a direction perpendicular to the center axis of the neck region 2, so as to be positioned corresponding to the beam exit end of the electron gun apparatus 4, namely, the output of the focusing and accelerating electrode 11. The third portion 21 functions to emit to the beam exit end in the neck region 2, the leakage flux received by the first portion 19 and transmitted through the second portion 20. The fourth portion 22 is formed by bending the top end of the first portion 19 to protrude toward the core 13. The fourth portion 22 is disposed in a manner penetrating into the core 13 as shown in the drawing. In such case, the fourth portion 22 and the core 13 are made out of contact so that they are not electrically connected with each other. In this embodiment, the rear end of the plastic liner 16 shaped along the neck region 2 and the funnel region 3 includes a flange 23 protruding externally, over which the magnetic member 18 is attached.

The core 13 includes an upper portion and a lower portion, both of which are coupled by a pair of clamp members 27 at right and left sides. In order to facilitate the coupling, depressions 28 are formed in the core.

Figure 3A:
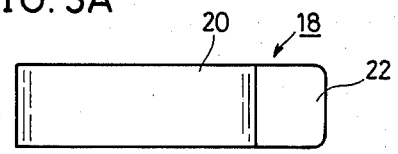
FIGS. 3A, 3B and 3C are plane views, a left side view and a front view, respectively, of an example of a magnetic member to be utilized in the present invention.
Figure 3B:
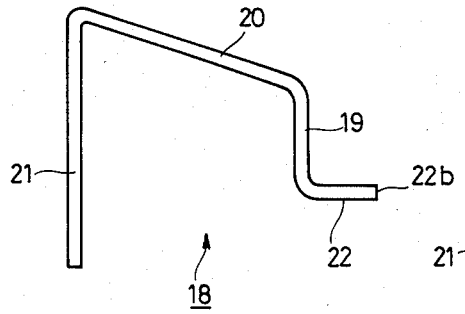
Figure 3C:
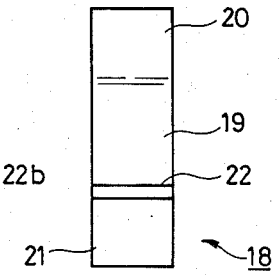

FIGS. 3A, 3B and 3C are plane views, a left side view and a front view, respectively, of the magnetic member 18 utilized in the system shown in FIGS. 1 and 2. As shown in the drawings, the magnetic member 18 is made of, for example, a continuous metallic piece bent at three points to form the first portion 19, the second portion 20, the third portion 21 and the fourth portion 22 as described above.

Figure 4:
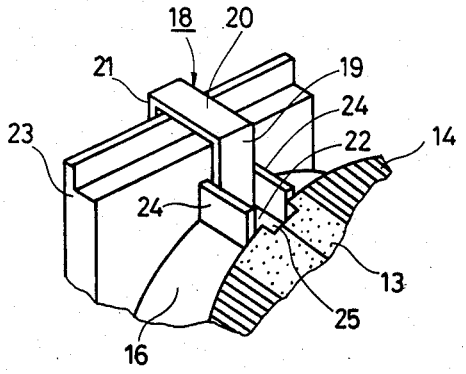
FIG. 4 is a perspective view of a portion in which a magnetic member is attached in the apparatus shown in FIGS. 1 and 2.

FIG. 4 is a perspective view of a portion where the magnetic member 18 is attached in the system shown in FIGS. 1 and 2. As described above, the flange 23 is formed at the rear end of the plastic liner 16 and the magnetic member 18 is attached over this flange 23. On the side of the front surface of the flange 23, a retaining frame 24 for positioning is formed. The fourth portion of the magnetic member 18 is inserted in this retaining frame 24 so that the position for fixation of the magnetic member 18 is determined. At the same time the fixation of the member 18 is maintained stably by this retaining frame 24. In addition, as shown in FIG. 4, a notch 25 may be formed in a portion of the rear end surface of the core 13 facing the fourth portion 22 so that the top end surface 22*b* (see FIG. 3B) of the fourth portion 22 may be positioned within this notch. Thus, the magnetic member 18 can be easily attached at the time of assembling.

Figure 5A:
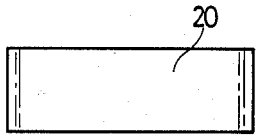
FIGS. 5A, 5B and 5C are plane views, a left side view and a front view, respectively, of another example of a magnetic member to be utilized in the present invention.
Figure 5B:
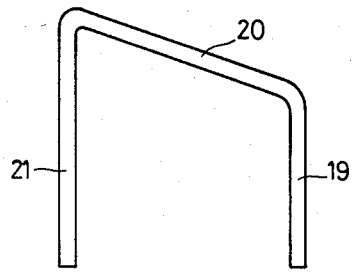
Figure 5C:
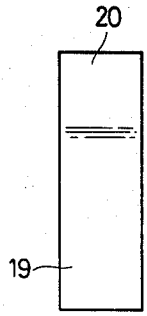
Figure 6A:
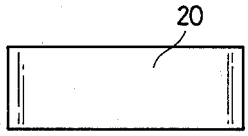
FIGS. 6A, 6B and 6C are plane views, a left side view and a front view, respectively, of a further example of a magnetic member to be utilized in the present invention.
Figure 6B:
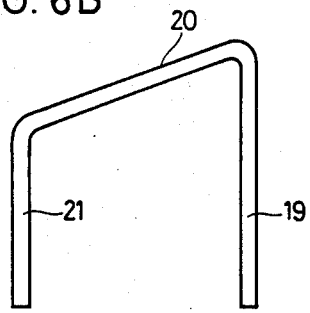
Figure 6C:
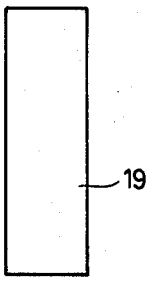
Figure 7A:
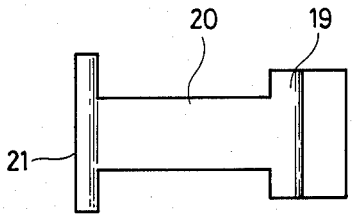
FIGS. 7A, 7B and 7C are plane views, a left side view and a front view, respectively, of a further example of a magnetic member to be utilized in the present invention.
Figure 7B:
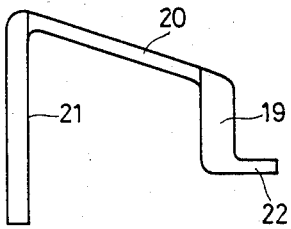
Figure 7C:
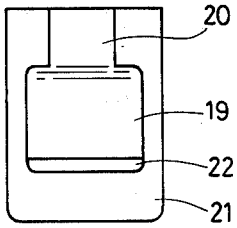

FIGS. 5A to 5C, FIGS. 6A to 6C and FIGS. 7A to 7C show respectively other examples of the magnetic member 18, corresponding of FIGS. 3A to 3C. In these drawings, the same portions as in FIGS. 3A to 3C are designated by the same reference numerals. The magnetic member 18 may be structured only by the first portion 19, the second portion 20 and the third portion 21, as shown in FIGS. 5A to 5C, the fourth portion 22 being not formed. In this case, the top end of the first portion 19 and the top end of the third portion 21 may extend downward to the same level. The first portion 19 may be longer than the third portion 21 as shown in FIGS. 6A to 6C. In addition, as shown in FIGS. 7A to 7C, the width of the respective portions need not be uniform and the first portion 19 and the third portion 21 may have larger widths. Thus, the efficiency in receiving the leakage flux in the first portion 19 can be made better. Furthermore, as shown in FIGS. 7A to 7C, the thickness of the respective portions needs not be uniform and the respective portions may have different thicknesses.

A suitable form of the magnetic member 18 is selected dependently on the shape, the size and the like of the color cathode ray tube 1 in which the magnetic member 18 is utilized, and accordingly, design of the magnetic member 18 may be made according to each apparatus to be applied based on the concept of the present invention. However, in any case, the magnetic member 18 is structured in accordance with the present invention such that the first portion 19 is opposed adjacent to the rear end surface of the toroidal-type core and the third portion 21 corresponds to the exit end of the electron beams and is positioned in a direction perpendicular to the length direction of the neck region 2. Thus, a considerable amount of leakage flux existing in the vicinity of the rear end surface 13*a* of the core 13 can be received efficiently so as to be emitted to the beam exit end as an effective magnetic flux.

As a more preferable position for attachment of the magnetic member 18, the rear end surface of the core 13 where the vertical deflection coils 14 are not wound in the first portion 19 is selected:

TABLE

| | | Present Invention | Conventional Apparatus |
|---|---|---|---|
| Convergence YH | | Improvement by 0.88 mm | Improvement by 0.58 mm |
| Pincushion Distortion | Vertical Distortion | Improvement by 0.22% | Improvement by 0.11% |
| | Horizontal Distortion | no change | Deterioration by 0.23% |
| Vertical Deflection Efficiency | | Improvement by 2.7% | Improvement by 1.8% |

The above indicated Table makes comparison between the characteristic data of a preferred embodiment of the present invention and those of a conventional apparatus.

Figure 8:
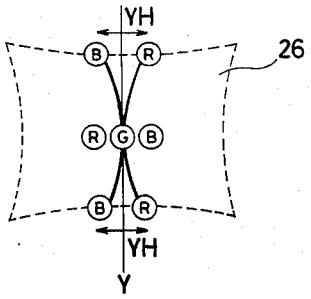
FIG. 8 is a schematic diagram showing the beam loci on display screen.

FIG. 8 is a schematic diagram showing the loci of the beams represented on a display screen. The embodiment indicated in the Table is the color television display apparatus shown in FIGS. 1 and 2, in which the form shown in FIG. 3 is applied for the magnetic member 18. The conventional apparatus in the Table is an apparatus in which a magnetic member made of the second portion 20 and the third portion 21 like the magnetic field shunt described in the above mentioned U.S. Pat. No. 4,335,366 is utilized instead of the magnetic member 18 of this embodiment. As the color cathode ray tube 1, a cathode ray tube provided with a so-called cross arm is utilized in either case.

The horizontal deviation amount of the R (red) beam and the B (blue) beam in the central portions of the upper and lower ends of the display screen, namely at the upper and lower ends on the Y axis in FIG. 8 is decreased by 0.58 mm in case where the magnetic member made of the second and the third portions 20 and 21 is attached, as compared with a case without attachment of such magnetic member and, misconvergence is improved by this decreased amount. On the other hand, in the embodiment of the present invention, improvement is made by 0.88 mm. As to the pincushion distortion of the raster 26, vertical distortion in the conventional apparatus is improved by 0.11% as compared with the case without the member, while in the embodiment of the present invention, vertical distortion is improved by 0.22% as compared with the case without the member. Horizontal pincushion distortion does not change in the embodiment, while in the conventional apparatus, horizontal distortion is deteriorated by 0.23%. In addition, as to the deflection efficiency, improvement is made only by 1.8% in the conventional apparatus, while in the embodiment, improvement is made by 2.7%.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In a color television display apparatus comprising:

a color cathode ray tube integrally structured by a neck region at the back, a display screen at the top and an intermediate funnel region connecting said neck region and said display screen;

an electron gun apparatus disposed within said neck region of said cathode ray tube, having means for producing three horizontal in-line electron beams and a magnetically-permeable focusing electrode for focusing the beams;

a deflection yoke disposed about said neck region and said funnel region of said cathode ray tube, including a core and vertical deflection coils toroidally-wound about said core, said coils producing a deflection magnetic field having deflection magnetic flux located within the interior of said yoke for effecting deflection of said beams in a vertical direction and leakage flux located external to said yoke; and magnetically-permeable means disposed adjacent to said yoke, for channeling a portion of said leakage flux beyond the rear of said yoke to the vicinity of the beam exit end of said electron gun apparatus for forming a barrel-shaped magnetic field at said exit end for interaction with said electron beams; the improvement wherein said magnetically-permeable means comprises first, second and third portions, said first portion being positioned adjacent to the rear end surface of said core, extending toward the center axis of said neck region in a direction perpendicular to said center axis, for receiving leakage flux produced mainly in said rear end surface of said core, said second portion extending backward from the outer end of said first portion, for transmitting backward the flux received by said first portion, and said third portion being connected to the rear end of said second portion, extending toward the center axis of said neck region in a direction perpendicular to said center axis, and being positioned corresponding to the beam exit end of said electron gun apparatus, said third portion functioning to emit said flux transmitted through said second portion to said beam exit end.

2. A display apparatus in accordance with claim 1, wherein said magnetically-permeable means comprises a fourth portion connected to the top end of said first portion, said fourth portion having an angle of approximately 90° with respect to said first portion, and protruding toward said core for receiving leakage flux produced in the interior of said rear end surface of said core.

3. A display apparatus in accordance with claim 2, wherein said fourth portion is interposed between the inner surface of the rear end of said core and said cathode ray tube.

4. A display apparatus in accordance with claim 1, wherein a gap is formed between said core and said first portion so that said core and said first portion may be electrically disconnected.

5. A display apparatus in accordance with claim 4, wherein a gap is formed between said core and said fourth portion so that said core and said fourth portion may be electrically disconnected.

6. A display apparatus in accordance with claim 1 or claim 4, wherein said deflection yoke further comprises an insulating member disposed inside said core, a convex portion protruding to the outside being formed at the rear end of said insulating member and a gap being formed between said core and said convex portion at the rear end of said insulating member, said magnetically-permeable means is disposed over said convex portion of the rear end of said insulating member.

7. A display apparatus in accordance with claim 1, wherein said cathode ray tube further comprises a magnetic piece, said magnetic piece covering at least the vicinity of the point where leakage flux at the top end of said deflection yoke has the maximum density, and extending along the side surface of said funnel region of said cathode ray tube toward the front end of said deflection yoke, so that the leakage flux of said deflection yoke may be transmitted toward the front end of said deflection yoke.

8. A display apparatus in accordance with claim 6, wherein said cathode ray tube further comprises a magnetic piece, said magnetic piece covering at least the vicinity of the point where leakage flux at the top end of said deflection yoke has the maximum density, and extending along the side surface of said funnel region of said cathode ray tube toward the front end of said deflection yoke, so that the leakage flux of said deflection yoke may be transmitted toward the front end of said deflection yoke.

* * * * *